US006352117B1

(12) United States Patent
Strickland

(10) Patent No.: US 6,352,117 B1
(45) **Date of Patent: *Mar. 5, 2002**

(54) OIL LIFT SYSTEM

(76) Inventor: Charles Strickland, Rte. 1, Box 119, Hampton, AR (US) 71744

( * ) Notice: Subject to any disclaimer, the term of this patent is extended or adjusted under 35 U.S.C. 154(b) by 0 days.

This patent is subject to a terminal disclaimer.

(21) Appl. No.: 09/207,883

(22) Filed: Dec. 8, 1998

Related U.S. Application Data

(63) Continuation-in-part of application No. 09/032,403, filed on Feb. 27, 1998.

(51) Int. Cl.[7] ..... E21B 43/00
(52) U.S. Cl. ..... 166/372; 417/53
(58) Field of Search ..... 166/250.15, 369, 166/370, 371, 372, 77.1, 90.1, 162, 168, 107; 294/68.22; 417/120, 53

(56) References Cited

U.S. PATENT DOCUMENTS

| | | | | | |
|---|---|---|---|---|---|
| 3,617,152 | A | * | 11/1971 | Cummings | 417/120 |
| 4,086,035 | A | * | 4/1978 | Klaeger, Jr. et al. | 166/168 |
| 4,583,916 | A | * | 4/1986 | Senghaas et al. | 294/68.22 |
| 5,911,278 | A | * | 6/1999 | Reitz | 166/372 |
| 6,039,544 | A | * | 3/2000 | Strickland | 417/53 |

* cited by examiner

*Primary Examiner*—William Neuder
(74) *Attorney, Agent, or Firm*—Bracewell & Patterson, L.L.P.

(57) ABSTRACT

A wellhead assembly including a skid, drum, cable spooled on the drum and level wind mechanism is set forth to extend the cable into and out of a well borehole for production of a well The cable spools over a measuring wheel extends into the well and supports a bail on the end of it. The bail has a foot valve for filling, thereby enabling retrieval of a bail into a surface located stinger connected with an air pump to force liquid from the bail. A control system enables cyclic operation.

20 Claims, 2 Drawing Sheets

OIL LIFT SYSTEM

This is a continuation in part of application Ser. No. 09/032,403 filed on Feb. 27, 1998.

BACKGROUND OF THE DISCLOSURE

The present disclosure sets out an economical oil lift system which is installed with reduced capital expenditures, and which has the benefit of reduced lifting cost during operations. It is intended to be used on stripper wells. Stripper wells are defined as those producing typically up to about 10 barrels of oil per day. They may produce water with the oil in quantities ranging from perhaps 10 or 15 times the volume as water to a negligible amount. As will be understood, stripper wells of that production volume simply are economically marginal and can be operated only if the capital costs and operational costs are reduced. The present disclosure sets out a method and apparatus for providing that kind of reduced capital and operational cost. The typical method of producing a stripper well is to install a wellhead pump jack, a string of sucker rods and a downhole pump. This requires pumping through a tubing string. To be sure, stripper wells are normally straight and relatively shallow requiring minimal installed equipment. Nevertheless, it is necessary to install the equipment in the well. This costs significantly to purchase and install the capital equipment. The wellhead equipment normally entails a walking beam and electric motor at the surface. That has a well known cost dependent on the size of the walking beam and motor. A well known and easily identified cost is also involved in the tubing and sucker rod string having a cost factor based on well depth. The downhole pump is installed at the lower end of the sucker rod string and has a well known cost.

Operational costs include the electricity required to power the pump, and periodic service of the wells. Servicing of a typical stripper well involves periodic removal of the sucker rod string, the tubing string and the downhole pump connected on that. Without regard to the nature of the service, the removal and reinstallation of these components involves a very significant and substantial economic outlay. This service routine is typically undertaken to clean out the well when there is an excessive accumulation of sand around the pump or paraffin along the tubing. Sometimes, the sucker rods must be pulled to inspect them and to make appropriate replacements or to install bumpers on them. Sometimes, sucker rods will drag, thereby damaging the surface of the rod string, and possibly wearing against the adjacent tubular goods. Service has a cost. Service for the present system is distinctly better. To begin with, the cased well is normally open from the wellhead down to the bottom of the well. The well is open so that the service personnel can work on the well without the delay of having to pull sucker rods and tubing. Service is done through the wellhead without the preliminary step of installing a workover rig to pull a few hundred feet of sucker rods. Indeed, a workover rig is often required to service shallow wells with pump jack and sucker rods. Workover rigs of necessity involve a larger truck which has to be driven the remote location of the wellhead, erected over the wellhead and then operated to pull all the tubular goods in the well. That preliminary step, even where the well is only 600 feet deep, takes two or three skilled personnel and requires at least an hour or two of operation ignoring the difficulties of getting the truck to the site and then onto the highway after the service job has been completed. Suffice it to say, the difficulties of servicing can range from relatively easy to tedious and difficult. These are activities and service charges which are avoided by the present oil lift apparatus.

This disclosure sets out a wellhead system which is installed on a skid adjacent to the wellhead which utilizes no sucker rods. Rather, it employs a drum which spools a lifting cable. The drum, cable spooling apparatus and supportive frame or skid are mounted adjacent to the wellhead. This equipment need not be moved at the time of servicing. Rather, the equipment inserted into the well comprises solely a bailing bucket and a long cable. The wireline is spooled on the drum. The wireline is relatively small and has only sufficient diameter to support the weight which is carried on it (often, it is called a slick line). That diameter or cable gauge is discussed in some detail below. The produced oil (and any water which is found with it) is bailed out of the well by an elongate tubular bailing bucket. The bail is raised with a full load of liquid retrieved from the well. It is raised to the wellhead where the liquid is then removed by a pump. The pump has an elongate stinger which extends into the bail, thereby pumping the retrieved liquid out of the bail and into a gathering system. When the bail is in the up position at the top end of its stroke, it delivers the liquid, leaving the cased well substantially clear. For service work, the bail is simply pulled from the wellhead equipment, laid aside for the moment and easy entry into the well is then obtained. Easy entry reduces the setup time to begin service. If the well is sanded up, it is easy to run a wash line into the well to dislodge and retrieve the accumulated sand, etc. At the completion of the service work, the wash equipment is simply pulled from the well and the bail is reinserted into the well. Removal of equipment from the well and restoration of that equipment is done easily.

A longer bail can be used. This longer bail can have sufficient length so that vacuum lift from liquid from the bail is not possible. With the bale in excessive of about 30 feet, the liquid head becomes so great that vacuum removal is not possible. The present disclosure sets out an improved bail where the liquid is removed from the bail by positive air pressure which displaces the liquid. An appropriate bail and stinger construction are set forth to enable this improved removal.

The present apparatus is summarized as equipment which is located at the surface. That equipment includes an elongate horizontal frame or skid which is either rested on the ground or elevated. The skid supports a cable winding mechanism adjacent to a cable storage drum. A level wind device is typically included. This provides a slick line which is extended from the storage reel or drum through the level winding device and then over a single measuring pulley. The pulley directs the cable downwardly into the well borehole. The equipment also includes certain load sensors which respond to the load on the slick line. The load on the line is measured dynamically so that the cable load alters the motor operation so that the cable is lowered from the surface, dropped into the liquid accumulated at the bottom of the well, filled and then the cable is retrieved with the filled bail on it. The bail, full of retrieved liquid, is pulled to the surface. When the bail arrives at the surface, a switch is triggered to stop further movement. In conjunction with that operation, a stinger is inserted into the bail to a depth to enable retraction by pump of the liquid in the bail.

Summarizing further, this disclosure sets forth an improved stinger and bail construction which cooperate together to enable delivery of a column of oil which is longer than 30 feet; it is sufficiently long that it enables removal by air displacement, not by vaccum lift. A stinger is provided which plugs the bale perfectly, thereby enabling air to be pumped into the bail and force any liquid in the bail from the bail into an oil recovery system.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
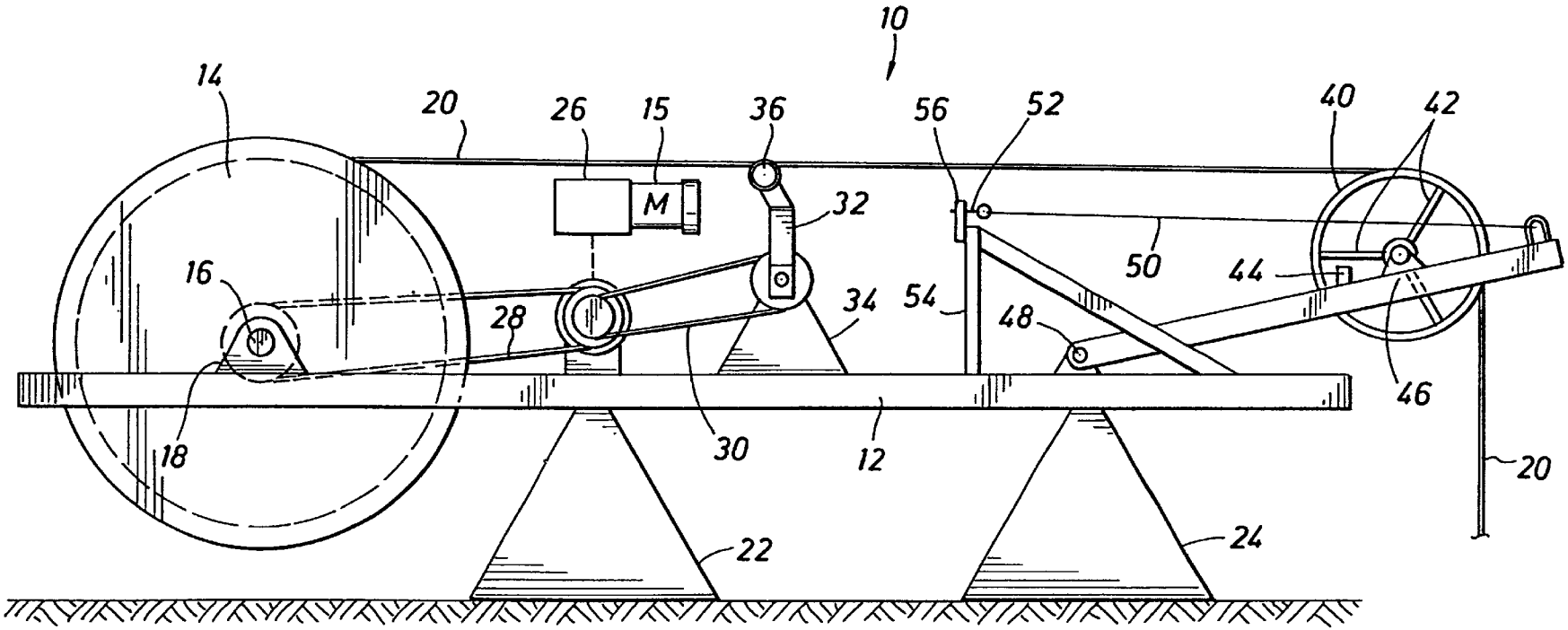
FIG. 1 is a side view showing the wellhead equipment of the present invention and includes an elongate horizontal frame supporting a drum or reel for storing a slick line extending into a well.

Attention is first directed to FIG. 1 of the drawings where the numeral 10 identifies the wellhead equipment which pumps produced oil and water from the well (to be described). Beginning at the left side of FIG. 1, an elongate skid or frame 12 made of two or more parallel frame members extends to the left to thereby support a large storage reel or drum 14. The drum 14 is supported on a centered shaft 16 which is rested on a pillow block 18 and is turned by a motor 15 through a gearbox 26. The shafts 16 are on both sides of the drum so that the drum is able to support a slick line or cable 20 having a length and diameter given below. The cable 20 is the lifting member. The drum is rotated clockwise and counter-clockwise by the electric motor 15 connected through the gearbox 26 to the drum to rotate the drum and thereby make repeated trips in the well to lift the produced oil and some water to the surface.

The frame 12 is supported on a left pylon 22 and a comparable or similar right pylon 24. This keeps it above ground level so that rust is reduced and service can be done. The drum 14 is rotated by the motor 15 through the gearbox 26 driving a chain 28. The motor additionally drives a second and synchronized belt or link chain 30 which connects with a level wind mechanism 32. The level wind mechanism 32 is mounted on a supporting frame member 34. It extends upwardly to position a guide pulley 36 engaging the cable 20 so that the cable 20 is appropriately guided for the reel or drum 14. The level winding mechanism traverses from left to right across or in front of the drum 14. The drum 14 stores the cable 20 on it in bights which are looped around the drum with a level accumulation. The cable is stored on the drum layer by layer across the width of the drum. While each row is wound on the drum, the bights are placed side by side to smoothly accumulate the cable. Among other things, this extends cable life and reduces pinching of the cable where it might be caught between bights and cut by later wraps of the cable on the drum. The level wind mechanism positions the guide pulley 36 so that the cable is moved left and right at a controlled rate which is synchronized with operation of the drum in either direction (winding or unwinding cable).

The length of cable extending horizontally is approximately eight feet so that the guide pulley 36 reciprocates to and fro without undue loading laterally where the cable 20 passes through the pulley 36.

The cable extends to the right side of FIG. 1 and passes over a measuring wheel 40. The measuring wheel has a surrounding groove on it which guides the cable 20 to turn downwardly into the well as will be described. The measuring wheel has three spokes which are counted as each pass by, each count equaling one foot. The spokes pass adjacent to a proximity detector 44. The detector 44 and the wheel 40 are mounted on a pair of pivoted support arms 46. Both arms 46 pivot at a common pivot point 48. As observed, the arms 46 rise and fall about the pivot 48. However, the arms are supported at a specified location by a pair of parallel anchor cables 50. Both anchor cables are tied to a dead end 52. Both dead ends are supported by fixed frame members 54. The arms 46 place a load on the dead end which load is measured by a strain gauge 56. The strain gauge measures the tension in the cable 50. With no weight on the cable 20, the strain gauge 56 will provide a baseline reading. When the weight increases, the strain gauge will provide that data. The weight of oil lifted on the cable 20 is directly measured by the strain gauge 56. By having a calibration value, the weight of lifted liquid is then indicated. The cable 50 transfers the load on the measuring wheel 40 to the load sensor 56.

Figure 2:
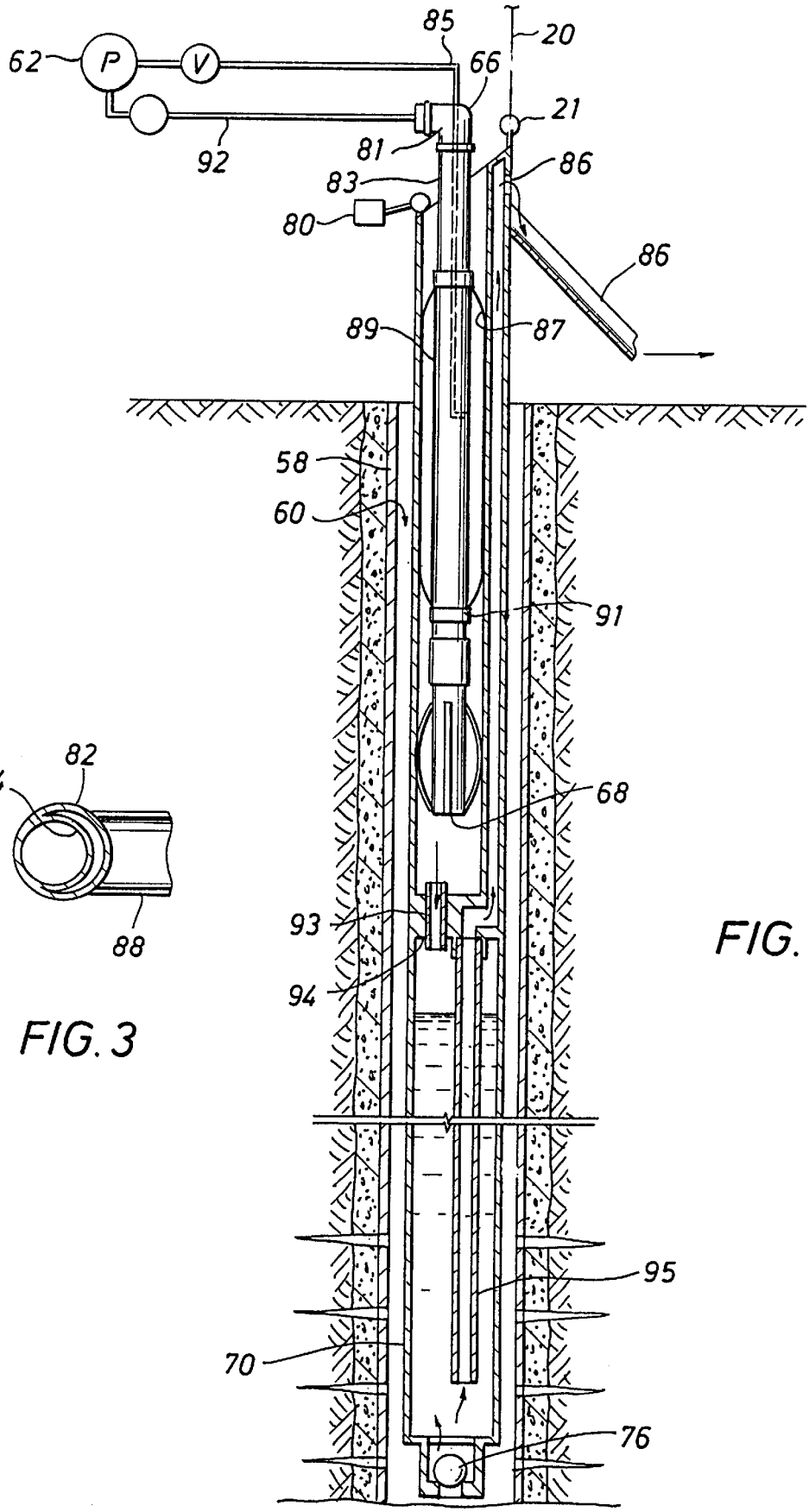
FIG. 2 is a sectional view through the wellhead showing the equipment located at the wellhead including a line supported bail which is raised and lowered on the line operated by the apparatus shown in FIG. 1 for retrieving produced fluid from the well.

Shifting now to FIG. 2 of the drawings, a casing 58 is placed in a well 60 and extends downwardly to the bottom of the well which is plugged with a bridge plug. In a manner determined from well to well, a set of perforations enables the adjacent formation to produce oil and some water into the liquid column at the bottom of the well. The wellhead equipment has been omitted in FIG. 2 for sake of clarity. FIG. 2 shows the cable 20 extending vertically so that it can lift the bail which is attached to the cable by swivel 21 in the well borehole. The bail removes the accumulated oil load by load. The wellhead equipment (walking beam) normally found at the well has been replaced by this invention which recovers the oil into the oil recovery system at this well.

A stinger 66 terminates at a stinger tip 68. The stinger tip encloses the open end of the stinger. The tip assembly 68 is centered with multiple arcuate springs to enable air flow from the stinger. It is preferably a large diameter pipe to deliver air to displace the oil in the bail for production.

FIG. 2 additionally shows a bail 70 which has the form of an elongate hollow tube. It is open at the top end, hookd to the eyelet 21 for connection with the cable 20. It is closed at the bottom end except a check valve 76 permits flow into the bail but prevents leakage from the bail 70. This is the mechanism by which the bail accumulates liquid. The bail has an internal capacity or volume. As a representative dimension, the bail is preferably about 1 to 1½ inches smaller in diameter than the well casing. This enables easy travel of the bail up and down the casing string. It is not uncommon to make the bail between 30 feet or more in length. Because it is sized with some clearance with respect to the casing 58, it is more or less centralized in the well so that the stinger 66 is aligned with the centerline axis of the casing. When the bail 70 is retrieved, the open upper end is appropriately aligned so that the stinger tip 68 enters the bail 70. By enlarging the stinger tip 68, it has such a size that it forces entry into the bail even should there be some misalignment.

The check valve 76 prevents liquid loss during retrieval of the bail 70. When it is raised, retrieved oil cannot escape through the valve 76. The produced oil is therefore recovered in the well and delivered to the surface through the stinger 66.

Travel of the bail 70 should now be considered. The upward range of travel is limited by a proximity switch 80. That switch connects with the electrical supply to switch off power to the motor 15. This holds the bail in the raised position shown in FIG. 2 against the switch 80. This is the upper limit of travel. The proximity detector 44 counts spokes (meaning feet of cable) to initiate operation of an air pump 62 at the proper time when the bail is around the stinger tip 68. Accordingly, when the lift motor 15 is switched off to end travel, the air pump 62 is switched on to force oil from the bail 70. The recovered oil is delivered by air pressure to a gathering system. This retrieves the oil from the bail 70. Substantially all the bail carried oil is collected. The pump 62 will stop when the weight set point is achieved. In other words, when the strain gauge 56 indicates that all of the fluid in the bail has been removed, the air pump 62 is switched off and the motor 15 is then switched on to lower the bail 70 back into the well.

The switch 80 initiates a signal stopping motor operation, holding the bail at the raised location while arresting travel of the cable and bail. Since operation of the air pump 62 is switched off after the oil is pumped out, that indicates liquid has been fully retrieved. After oil removal, the motor 15 is operated in the reverse direction to thereby lower the bail 70 into the well. The measuring wheel 40 is rotated for a specified number of intervals until the bail is close to the liquid level in the well. In ordinary operation of the well, the recovered liquid will accumulate to a specified head. The head of liquid defines a depth at which oil recovery can begin from the well. This head of liquid will have a certain depth in the well. Assume as an easy example that the head of liquid is exactly 1,000 feet below the equipment shown in FIG. 1. The measuring wheel 40 rotates to measure the length of cable spooled into the well so that the cable can be slowed as the accumulated head is approached. The motor 15 can therefore run at a relatively high speed until the bail is within about 50 feet or so. At that point, rotations of the measuring wheel trigger a change in motor speed. The motor is preferably slowed. At this juncture the weight on the cable 20 is measured. The weight is measured at the dead end sensor 56 and the weight comprises only two components which are the weight of the empty bail and the weight of cable hanging over the measuring wheel. The motor is slowed so that the bail then moves downwardly into the accumulated head of oil; at this point the buoyancy of the empty bail reduces the weight at the dead end sensor 56. The filling rate is defined primarily by the valve 76 size at the bottom of the bail. The buoyancy is used to advantage as a load related signal. The motor 15 is operated slowly while the reduced load is sensed on the dead sensor 56. As the bail fills, the load on the cable 20 will change. This load will change, thereby forming a signal that the load is changing with filling. As that load ultimately changes, it will form an indication that the bail has been fully filled to the top. After that occurs, the weight on the measuring wheel will be substantially restored because filling of the bail reduces the buoyant effect of floating on the surface. Moreover that event triggers operation of the motor 15 to then raise the cable and bail by operating in the opposite direction. The motor is then operated to retrieve the cable 20 and thereby lift the bail.

POSITIVE AIR DISPLACEMENT STINGER AND BAIL CONSTRUCTION

Going now to FIG. 2 of the drawings, the stinger 66 is a structure which is located at the well head and stabs into the well, extending into the casing 58. It has the stinger tip 68 which is provided with centralizing springs to assure alignment. The bail 70 is cut with a tapered upper end. The diameter of the bail is calculated so that it is more or less centralized in the casing 58 and alignment is easily achieved. The bale is formed of an outer pipe which is sized to fit within the casing without snagging on the collars. Typically, this requires an outer shell which is approximately 1 inch less in diameter than the casing. Going momentarily to FIG. 3 of the drawings, the outer pipe defining the bail 70 is identified by the numeral 82. On the interior, there is a short pipe section 84 which is joined at one side. This defines an annular flow space between the two pipe sections 82 and 84 best shown in FIG. 3. Because the second pipe is smaller and off center, this locates the flow section on one side. That is located immediately adjacent to an opening 86 that is just below the swival 21. The opening 86 is located on that particular side and just below the cable 20 so that oil when delivered flows out and falls into a trough 88. The trough 88 is a sloping gutter which produces oil downwardly into a sump where it is removed by a production pump and delivered to a tank in a tank battery. Typically, the sump, pump, and tank are located off to the side and are not illustrated in FIG. 2; it will be observed that FIG. 3 includes the chute or trough 88 which is conformed at its tipped end so that it makes appropriate contact against the bail 70.

Consider now the construction of the stinger. In effect, it serves as a cork to plug the bail. To do this, it is sized to fit inside the smaller pipe 84. The stinger tip 68 fits into the pipe 84 and stabs into it by a specified depth. The stinger in this instance can be quite short, typically only about 2 to about 3 feet in length. The stinger at the upper end is constructed with an elbow 81 connected to a downwardly extending pipe 83, the pipe 83 extending all the way to the stinger tip 68. There is a small gauge airline 85 which extends down through the stinger pipe 83 and which emerges at an outlet inside of a bladder. The bladder is formed of an outside expandable bladder sleeve 87 and is concentric about the pipe 83. The inside of the bladder is defined by a second sleeve 89. The sleeve 87 cooperative with the sleeve 89 is sealed to define an encircling baldder. At the top and bottom ends, the bladder is sealed against leakage by a clamp collar 91. It is duplicated at both ends to assure locking of the bladder. Air from the pump 62 is valve controlled and deliverd through the small line 85 and into the bladder. When inflated, the bladder enlarges and plugs the pipe 84. When plugged, air cannot escape pass the stinger.

There is a second airline 92 delivering air from the pump 62 down through the stinger 68 and out of the stinger. This air fills the pipe 84, but cannot escape or flow upwardly. It flows downwardly. Recall that the stinger is of rather short length, and this length is tailored to the length of the pipe 84. Assume for purposes of example that the stinger is about 3 feet in length; the pipe 84 is that long and slightly longer, thereby defining a limited penetration for the stinger. The stinger enters the bail to that depth, delivering air under pressure, and the air flows downwardly and into a passage 93 in a transverse bulk head 94. There is an oil drain line 95 which extends fully to the bottom of the bail. If the bail is longer than about 30 feet, vaccum lift is not possible, but it can be any length. The line 95 extends down to the bottom and has a clearance of just an inch or two above the bottom end of the bail. This enables the entire column of liquid to be lifted. The flow path is driven by air under pressure which forces the accumulated liquid down and out through the line 95. That line 95 extends upwardly through or past the bulk head 94 and into the annular gap between the pipes 82 and

Figure 3:
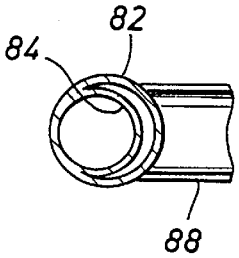
FIG. 3 is a sectional view showing bail construction coupled with a drain and sump.

84 best shown in FIG. 3. This forces oil to the top end of the bail where it cascades out through the trough or gutter 86 which is carried away to the sump, pump, and tank.

ROUTINE REPETITIVE OPERATION

The cable preferably has a length equal to the depth of the well plus added length to enable the cable to be periodically inspected and the ends trimmed. In addition the cable has a diameter sufficient to raise the weight involved. That total weight on the cable is the empty weight of the bail, the weight of enclosed liquid (approximately 8 pounds per gallon), and the weight of the cable itself. Cable diameter is preferably sufficient to carry the above mentioned load plus as safety margin of perhaps an additional 1,000 pounds or so. A single strand slick line or woven cable are both equally acceptable provided they have the capacity and length noted.

The operating cycle should be noted. Any well has a maximum production rate. As it is pumped off, production will typically increase somewhat but not excessively. The production rate should therefore be adjusted so that the percolation rate of oil and water from the formation is steadily matched with the rate at which the lifted liquid consistently removed. Each cycle of operation involves four events in sequence which are (1) the time to lower the bail from the surface to the head of oil, (2) the time for the bail to fill, (3) the retrieval interval, and (4) the interval of time during which the pump 62 removes the oil. Filling and draining typically occur in a span of just two or three minutes. Travel along a well of 1,000 feet should be at a rate of between 50 and 100 feet per minute. Retrieval under load is typically about the same speed or slower. Accordingly, in a 1,000 foot well and using rates of 50 feet per minute, this involves a cycle of operation of about 20 minutes to lower the bail, three or four minutes to fill the bail, 20 minutes for retrieval and about 4 minutes for draining. The total cycle will be somewhere between 45 and 50 minutes. At that rate, the system can make about 25 to 30 trips per day. If the well is producing 10 barrels of oil and water daily, and 30 trips are made, then one-third barrel each trip should be retrieved. This defines an approximate scale for the bail in this context. If another well produces 24 barrels per day, then one barrel must be removed each hour. With a bail of one-half barrel, the rate of travel must be two trips per hour to produce that well.

In a first preferred embodiment, the cable 20 has a diameter of 0.072 inches and the bail has a capacity of 11 gallons, thereby representing a total bail weight (when filled) of 175 pounds. In a second embodiment, the bail can be any length and is still light enough to be handled by one person. For instance, a 4 inch bail pipe of 40 feet can be lifted by one person.

At the time of service, the preliminary steps for executing service are simply removal of the bail 70 and the stinger 66. They are set aside to clear the well borehole to permit easy access to it. While the bail may be fairly long, even 30 feet or more in length, the size of the bail enables easy handling by one service person. Accordingly, service of the present system is done more easily than heretofore. In fact, a workover rig is not needed for this kind of service. Rather, spaghetti or coiled tubing on a drum can be used in washing the well.

While the foregoing is directed to the preferred embodiment, the scope is determined by the claims which follow.

What is claimed is:

1. A method of producing a well, the well comprising a wellhead at the earth's surface and a wellbore extending into the earth, the method comprising the steps of:

(a) lowering a bail into a well on a wireline;

(b) filling the bail with produced well liquids;

(c) retrieving the bail to the wellhead to a position near the wellhead;

(d) inserting a stinger into the retrieved bail during retrieval so that the stinger extends into the produced well liquids in the bail;

(e) pumping air positively through the stinger to force from the bail the produced well liquids; and (f) lowering the bail into the well for subsequent retrieval of additional well liquids.

2. The method of claim 1 wherein the bail is raised and lowered controllably by measuring the weight on the cable.

3. The method of claim 1 including the preliminary step of positioning the stinger in the well to align with and enter the top open end of said bail for liquid retrieval.

4. The method of claim 3 including the step of filling the bail through a selectively opened valve.

5. The method of claim 3 including the step of opening and closing a check valve to control bail filling.

6. The method of claim 1 including the step of weighing the bail to control bail lowering.

7. The method of claim 6 including the step of weighing the bail to control bail retrieving.

8. The method of claim 1 including the step of moving the bail toward the surface until it is halted and then expanding the stinger to plug the bail.

9. The method of claim 1 further comprising repeating steps (a) through (e) repeatedly to recover oil.

10. The method of claim 1 including the step of passing the wireline over a measuring wheel to measure bail location.

11. The method of claim 10 including the step of moving the bail at different speeds.

12. A well pumping apparatus adapted to be positioned at a wellhead over a wellbore, the apparatus comprising:

(a) a support adjacent to the wellhead;

(b) a drum storing cable operable in both directions to retrieve or extend therefrom wherein the cable extends into the well borehole;

(c) a source of pressurized air coupled to the apparatus;

(d) a bail attached to the end of the cable;

(e) a stinger adapted to insert into the bail on retrieval thereof to enable pressurized air from the source of pressurized air to force oil from said bail; and (f) a control system for responsively lowering and raising the bail to thereby remove produced liquids from the well in the bail and to return the bail into the well borehole for cyclic operation.

13. The apparatus of claim 12 wherein said drum is motor driven to operate said cable and said motor is operated by said control system.

14. The apparatus of claim 13 wherein said motor connects to said drum for rotation thereof, and said motor and drum control wireline tension to enable wireline winding on said drum.

15. The apparatus of claim 12 wherein said control system comprises a cable position sensor responsive to cable position to move said cable.

16. The apparatus of claim 12 wherein said control system comprises a cable weight sensor responsive to cable position to move said cable.

17. The apparatus of claim 12 wherein said bail includes a bottom located filing valve.

18. The apparatus fo claim 12 wherein said stinger fits into said bail and is sealed therein by an inflatable bladder plugging said bail.

19. The apparatus of claim 18 wherein said stinger includes an elongate air line introducing air into said bail to force liquid therefrom.

20. The method of claim 1 including the step of positioning an air line into said bail to introduce air under pressure, and directing liquid under pressure from the bail.

* * * * *